US009468281B2

(12) United States Patent
Schreiber et al.

(10) Patent No.: US 9,468,281 B2
(45) Date of Patent: Oct. 18, 2016

(54) APPLICATOR FOR A COSMETIC PRODUCT, IN PARTICULARLY MASCARA, AND METHOD OF MANUFACTURING SUCH AN APPLICATOR

(71) Applicant: ALBEA SERVICES, Gennervilliers (FR)

(72) Inventors: Camille Schreiber, Paris (FR); Anne Rutigliano, Maisons-Laffitte (FR); Patrick Lhoyer, Mouy (FR)

(73) Assignee: ALBEA SERVICES, Gennevilliers (FR)

( * ) Notice: Subject to any disclaimer, the term of this patent is extended or adjusted under 35 U.S.C. 154(b) by 24 days.

(21) Appl. No.: 14/667,047

(22) Filed: Mar. 24, 2015

(65) Prior Publication Data

US 2015/0272302 A1 Oct. 1, 2015

(30) Foreign Application Priority Data

Mar. 25, 2014 (FR) ..... 14 52518

(51) Int. Cl.

| | |
|---|---|
| ***A46B 9/02*** | (2006.01) |
| ***A45D 40/26*** | (2006.01) |
| ***A46B 3/18*** | (2006.01) |
| ***A46D 3/05*** | (2006.01) |
| ***A46D 9/00*** | (2006.01) |

(52) U.S. Cl.

CPC ..... *A45D 40/265* (2013.01); *A46B 3/18* (2013.01); *A46B 9/021* (2013.01); *A46B 9/028* (2013.01); *A46D 3/05* (2013.01); *A46D 9/00* (2013.01); *A46B 9/026* (2013.01); *A46B 2200/1053* (2013.01)

(58) Field of Classification Search

CPC ..... A46B 9/026; A46B 9/028

USPC ..... 401/129; 15/206, 207; 132/218, 317

See application file for complete search history.

(56) References Cited

U.S. PATENT DOCUMENTS

| | | | | |
|---|---|---|---|---|
| 6,494,215 | B2 * | 12/2002 | Gueret | A45D 33/02 132/218 |
| 8,091,561 | B2 * | 1/2012 | Gueret | A46B 9/021 132/218 |
| 9,016,288 | B2 * | 4/2015 | Wyatt | A46B 1/00 132/218 |
| 9,107,487 | B2 * | 8/2015 | Gueret | A45D 40/267 |
| 2002/0020426 | A1 | 2/2002 | Guerot | |

FOREIGN PATENT DOCUMENTS

| | | | |
|---|---|---|---|
| FR | 2811525 | A1 | 1/2002 |
| FR | 2991560 | A1 | 12/2013 |
| WO | 2009153761 | A2 | 12/2009 |

OTHER PUBLICATIONS

Dec. 10, 2014—(FR) Search Report—App 1452518.

* cited by examiner

*Primary Examiner* — David Walczak
*Assistant Examiner* — Joshua Wiljanen
(74) *Attorney, Agent, or Firm* — Banner & Witcoff, Ltd.

(57) ABSTRACT

An applicator for a cosmetic product, in particular mascara, comprises a twisted core and fibres that extend from the core being held by the core, the core having a distal end and a proximal end, the fibres forming an envelope (E) with their free end, characterised in that the envelope (E) has curved faces (F1-F4) with at least one slope, or inclination, from the distal end to the proximal end, the slope or inclination changing direction from one face (F1, F3) to the other (F2, F4) so that the envelope (E) has hollows alternating with raised parts around the core.

17 Claims, 2 Drawing Sheets

APPLICATOR FOR A COSMETIC PRODUCT, IN PARTICULARLY MASCARA, AND METHOD OF MANUFACTURING SUCH AN APPLICATOR

CROSS REFERENCE TO RELATED APPLICATIONS

This application claims priority to French Application Serial No. 1452518, filed Mar. 25, 2014, which is hereby incorporated by reference in its entirety.

BACKGROUND

The invention relates to an applicator for a cosmetic product, in particular mascara. The invention further relates to a method for manufacturing such an applicator.

Applicators for mascara can be injection-moulded from plastic material, they are then commonly called "plastic brushes". They can also be obtained using fibrous elements held between the longitudinal parts of a twisted metal spindle; they are then commonly called "twisted brushes". Applicators for a cosmetic product have a core, or central part, and spikes extending radially around said core. The extremities of said spikes usually form envelopes extended in a longitudinal direction of extension of said applicator. The spikes of twisted brushes are commonly called "the fibres".

Plastic brushes of the prior art have distributions of spikes around the core which allow the formation of complex envelopes that facilitate the application of make-up. With regard to twisted brushes, such features appear to be more difficult to obtain, unless operations are used to cut the fibres along paths that are difficult to implement.

SUMMARY

The aim of the invention is to improve the situation and the invention relates to an applicator for a cosmetic product, in particular mascara, comprising a twisted core and fibres that extend from the core and are held by said core, said core having a distal end and a proximal end, said fibres forming an envelope with their free end.

According to the invention, said envelope has curved faces having at least one slope, or inclination, from said distal end to said proximal end, said slope or inclination changing direction from one face to the other so that said envelope has hollows alternating with raised parts around said core, in other words, when turning around said core in a plane orthogonal thereto, and advantageously, along the entire length of the core from its distal end to its proximal end. "Curved faces" means non-plane faces. Faces with mere surface undulations are not understood as being curved either.

The applicator of the invention proposes a particular arrangement of fibres that offers specific advantages for the distribution of mascara, for example, concerning functions such as loading or combing. This arrangement improves the lash-thickening, lash-lengthening and/or lash-separation effects produced by the application of mascara using the applicator of the invention, doing so with choices of outlines that remain relatively easy to obtain. In addition, the use of a twisted brush, such as the applicator of the invention, makes it possible to have a greater density of fibres than with the spikes of plastic brushes.

According to different embodiments of the invention, which can be taken together or separately:

- said fibres are distributed around said core over a substantial portion of its length beginning from the distal end;
- said proximal end is extended by a rod devoid of fibres;
- said faces are delimited by unconnected lateral edges, that is, edges that do not have a common point, including at their longitudinal ends;
- the direction of said slope, or inclination, is inverted alternately around said core, from one face to the other;
- said envelope comprises at least two pairs of faces;
- each face belonging to a said pair is opposed to the other face of said pair relative to the core of the brush;
- the two faces in a single pair have opposed slopes or inclinations;
- the direction of said slopes, or inclinations, is inverted from one pair of faces to the other;
- the faces of a single pair are symmetrical relative to a median plane comprising the core;
- the envelope comprises a pair of curved faces which are substantially convex from the distal end to the proximal end of the core, and a pair of curved faces which are substantially concave from the distal end to the proximal end of the core;
- the core has a region which is situated between its distal and proximal ends, known as the intermediate region, which in particular is substantially equidistance from the said distal and proximal ends;
- the envelope comprises a pair of curved faces that have a concave undulation from the distal end to said intermediate region and a convex undulation from said intermediate region to the proximal end, and a pair of curved faces that have a convex undulation from the distal end to said intermediate region and a concave undulation from said intermediate region to the proximal end;
- each of the curved faces is generated by a straight line, known as the generatrix line, said generatrix line being orthogonal to the core and orthogonal to the plane of symmetry of said face;
- the envelope has a transverse cross-section in a plane substantially orthogonal to the core, the shape of which is a polygon, along the entire length of said core, from said distal end to said proximal end;
- said shape is in particular a quadrilateral, or a rectangle;
- said envelope has chamfers on all or part of its faces, at the distal end of said core;
- said envelope comprises at least two opposed faces with chamfers symmetrical in relation to said core;
- said envelope is a helical envelope;
- said core consists of a twisted rod;
- the core is straight.

The invention also relates to a method for manufacturing an applicator for a cosmetic product, in particular mascara, said method comprising:

- a step of positioning a plurality of fibres between longitudinal portions of a spindle, then
- a first step of twisting said spindle in order to form a twisted spindle with fibres extending radially around it, the ends of said fibres forming a cylindrical envelope extending in a longitudinal direction of extension around said spindle, then
- a step of cutting the fibres, so that said fibres form an envelope with their free end, said envelope having curved faces with at least one slope, or inclination, from said distal end to said proximal end, said slope or inclination changing direction from one face to the other so that said envelope has hollows alternating with raised parts around said core, in particular an envelope as described above.

The applicator manufactured in this way has the advantage of comprising a distribution of fibres, the ends of which form a complex envelope around its core, by using an operation that remains simple to implement, namely, here, a step of cutting.

According to different embodiments of the invention, which could be taken together or separately:

said method comprises a second step of twisting said spindle after said step of cutting the fibres;

said cutting is digitally controlled.

The invention also relates to a container for cosmetic product, in particular mascara, capable of containing an applicator as described above.

The invention will be better understood, and the other aims, details, features and advantages thereof will become more clearly apparent on reading the detailed explanatory description that follows, of at least one embodiment of the invention given as a purely illustrative and non-restrictive example, with reference to the accompanying diagrammatic drawings.

DETAILED DESCRIPTION

Figure 1:
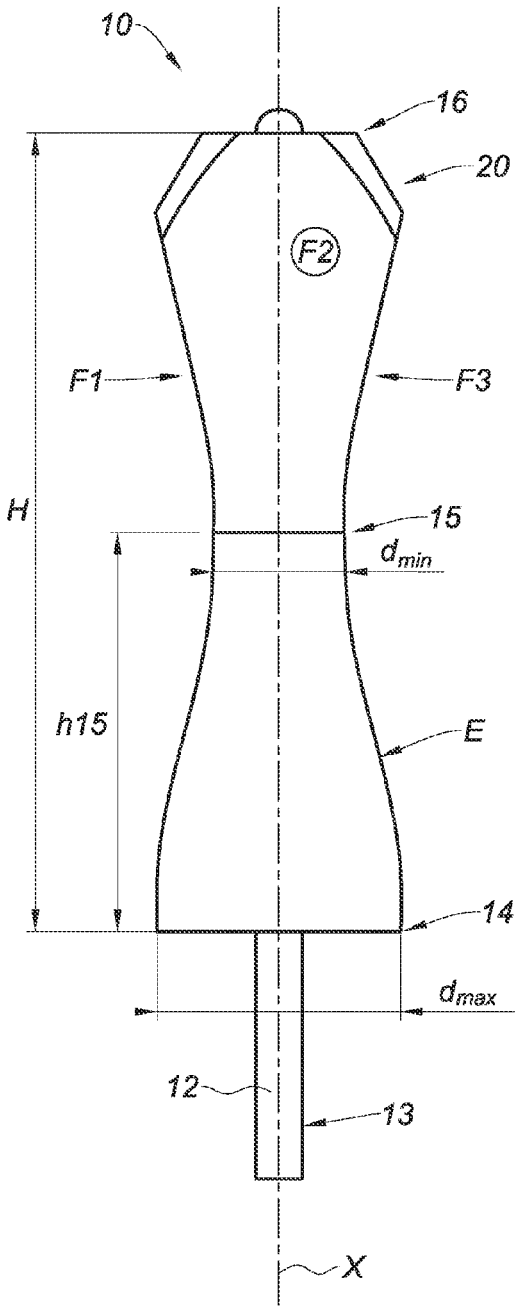
FIG. 1 is a frontal view of a first embodiment of an applicator according to the invention.

The invention relates to an applicator 10 for a cosmetic product, in particular mascara, comprising a twisted core 12 and fibres that extend from the core 12 while being held by said core 12.

The core 12 is here formed by a metal rod, or spindle, comprising two arms, or longitudinal parts, which may be connected to one another by a curved part. Said metal rod is, for example, bent in two so as to form a "U", the arms of the U being subsequently twisted with one another.

The fibres extend radially from the core 12, between a distal end 16 and a proximal end 14 of the core 12. The fibres each have a free end and they form an envelope E therewith. FIGS. 1 to 4 illustrate, in particular, two embodiments of the envelope E according to the invention. It will be appreciate that impression of an envelope will be more or less evident depending on the density of the fibres.

The applicator 10 extends in a main direction of longitudinal extension, or main axis, which is referenced X in FIGS. 1 to 4. This axis X is also advantageously the axis of the core 12. Advantageously, the core 12 will therefore be straight.

Thus, the fibres extend radially, from the core 12, that is, transversely to the axis X, to form different envelopes E with their free end, between the distal 16 and proximal 14 ends of the core 12. These ends 14, 16 are opposed relative to the axis X and are distanced from one another, along said axis X, by a distance referenced H in FIGS. 1 and 3. Said distance H is for example in the range between 22 mm and 30 mm, and is for example approximately equal to 26 mm or to 27 mm. It should be noted that the proximal end 14 is here extended by a portion of the rod that is devoid of fibres.

As FIGS. 1 to 4 show, the envelope E has curved faces F1-F4 having at least one slope, or inclination, from said distal end 16 to said proximal end 14.

Said slopes or inclinations change direction from one face F1, F3 to the other F2, F4 in such a way that said envelope E has hollows alternating with raised parts around said core 12, that is, when turning around said core in a plane orthogonal thereto, and advantageously, along the entire length of the core 12, from its distal end 16 to its proximal end 14.

Thus, in FIG. 1, the hollows are situated in the vicinity of an intermediate line 15 situated between the distal end 16 and the proximal end 14. Said intermediate line 15 belongs to a plane substantially orthogonal to the axis X that comprises an intermediate point of the axis X, said point being advantageously equidistant from said ends 14, 16. The distance h15 separating the proximal end 14 from this intermediate line 15, following said axis X, is substantially equal to 13 mm for example. This intermediate line 15 is an imaginary line that follows the perimeter of the envelope E.

Figure 2:
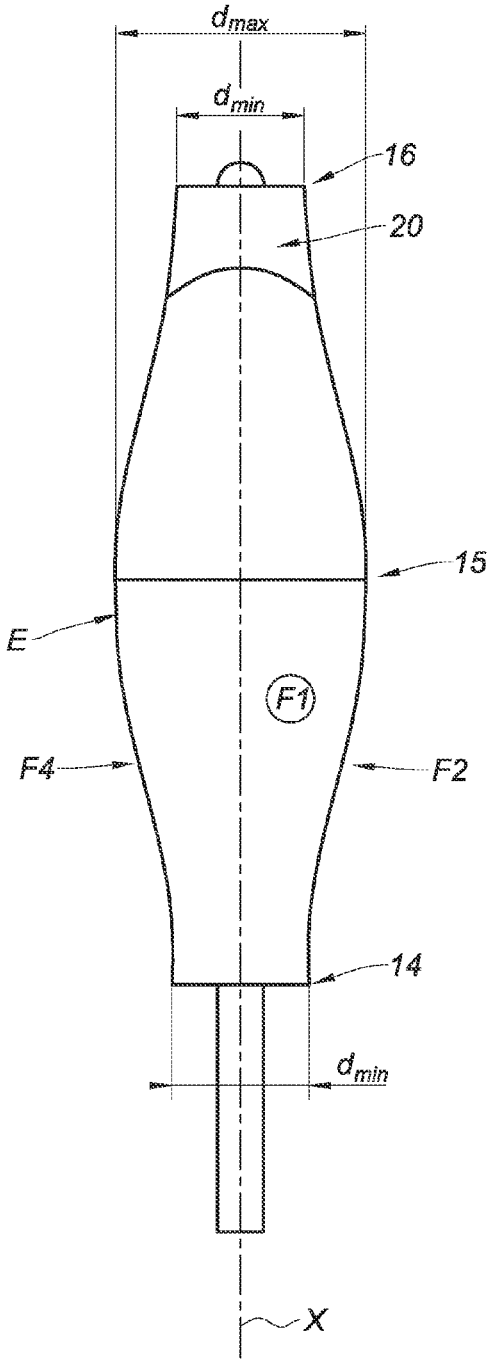
FIG. 2 shows the applicator in FIG. 1 after it has been rotated a quarter-turn around its longitudinal axis.

In contrast, when the applicator 10 is viewed from the side, as shown in FIG. 2, the hollows are close to the distal and proximal ends 14, 16 and the raised parts are close to the intermediate line 15.

The envelope E of the embodiment shown in FIGS. 1 and 2 therefore comprises a pair of substantially convex curved faces F2, F4 from the distal end 16 to the proximal end 14 of the core 12.

It should be noted that FIG. 1 shows the face F2 by its outlines, in a plane (that of the sheet of paper); however, the curvature in space of said face F2 can be seen in FIG. 2 because it is shown in profile there.

The envelope E of the embodiment shown in FIGS. 1 and 2 comprises, in addition, a pair of substantially concave curved faces F1, F3 from the distal end 16 to the proximal end 14 of the core 12 (illustrated in FIG. 2 but whose curvature in space can be seen in FIG. 1).

Figure 3:
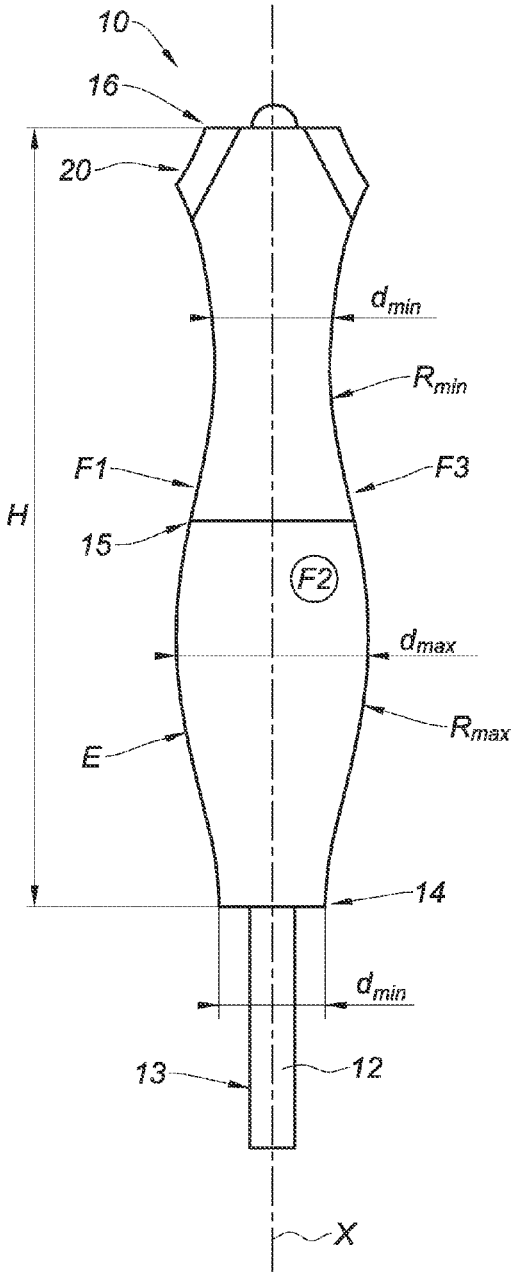
FIG. 3 is a frontal view of a second embodiment of an applicator according to the invention.
Figure 4:
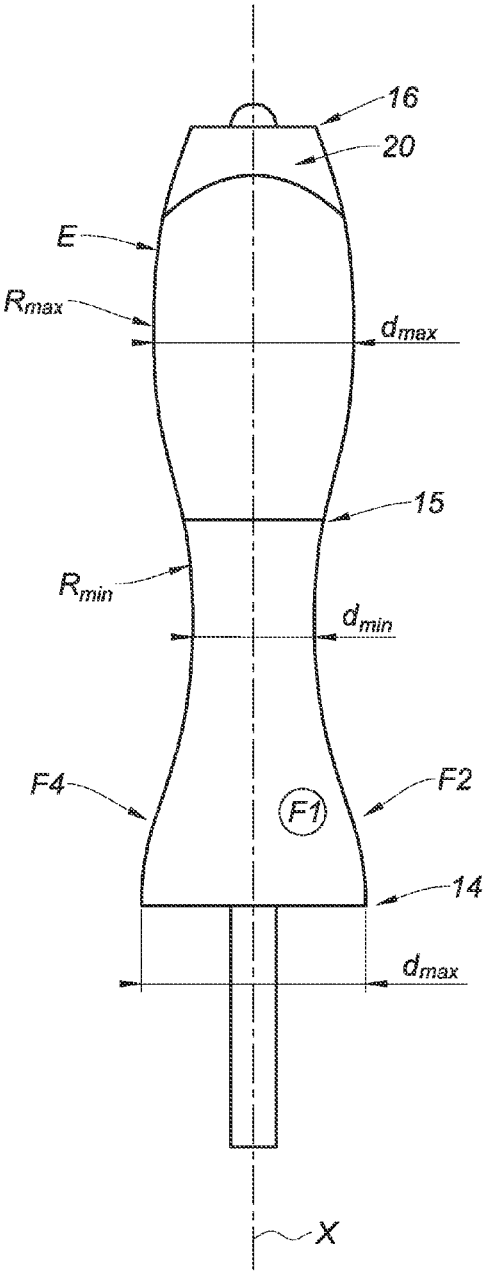
FIG. 4 shows the applicator in FIG. 3 after it has been rotated a quarter-turn around its longitudinal axis.

FIGS. 3 and 4 show another embodiment of an applicator 10 according to the invention. Thus, in FIG. 3, the hollows are situated between the distal end 16 and the intermediate line 15 and also in the vicinity of the proximal end 14, whereas the raised parts are situated in the vicinity of the distal end 16 and also between the intermediate line 15 and the proximal end 14.

In contrast, when the applicator 10 is viewed from the side, as shown in FIG. 4, the hollows are situated in the vicinity of the distal end 16 and also between the intermediate line 15 and the proximal end 14, whereas the raised parts are situated between the distal end 16 and the intermediate line 15 and also in the vicinity of the proximal end 14.

The envelope E of the embodiment shown in FIGS. 3 and 4 therefore comprises a pair of curved faces F1, F3 that have a concave undulation from the distal end 16 to said intermediate line 15 and a convex undulation from said intermediate line 15 to the proximal end 14; the outline of these faces F1, F3 is shown in FIG. 4 but their curvature in space can be seen only in FIG. 3, said faces F1, F3 being seen in profile there.

The envelope E of the embodiment shown in FIGS. 3 and 4 also comprises a pair of curved faces F2, F4 that have a convex undulation from the distal end 16 to said intermediate line 15 and a concave undulation from said intermediate line 15 to the proximal end 14; the outline of these faces F2, F4 is shown in FIG. 3, their curvature in space can be seen in FIG. 4.

As an example, the concave curves mentioned above will advantageously have a radius of curvature, referenced Rmin in FIGS. 3 and 4, which is included in the range between 15 and 20 mm and which is substantially equal to 17 mm, preferably to 17.3 mm. Similarly, the convex curves mentioned above will advantageously have a radius of curvature Rmax included in the range between 17.5 and 22.5 mm and substantially equal to 20 mm.

The envelopes E of the embodiments that have just been described each comprise two pairs of faces F1, F3 and F2, F4, that are symmetrical in pairs relative to a median plane comprising the core 12. These two embodiments are not restrictive and the applicator 10 could have three, or four, or even six pairs of faces symmetrical in pairs, without departing from the scope of the invention.

Each face belonging to a said pair is opposed to the other face of said pair relative to the core of the brush, or is symmetrical relative to a median plane passing through the core, and both faces of the same pair will have the same slopes, or inclinations, in a positive or negative direction, the slopes or inclinations changing direction from one pair of faces to the other. More precisely, said slopes, or inclinations, reverse direction from one pair of faces to the other.

Thus, when the applicator 10 of the invention is seen from the front, and the observer then causes it to turn around the axis of symmetry X of its core 12, he sees the faces F1-F4 alternate with the slopes that change, and more particularly, he sees the faces alternate with the slopes with a direction which is inverted, alternately and along the entire length of the X axis.

This alternation of slopes around and along the length of the core 12 advantageously makes it possible to cause combing surfaces and loading surfaces to alternate around and along the length of the applicator 10.

It should be noted that said faces F1-F4 are advantageously generated by a straight line, called a generatrix line, orthogonal to the core 12 and orthogonal to the plane of symmetry of each of said faces F1-F4. Thus, the envelope has a transverse cross-section in a plane substantially orthogonal to said axis X, the shape of which is a polygon, along the entire length of said core 12, from said distal end 16 to said proximal end 14, said shape being in particular a quadrilateral, or a rectangle, in particular at the intermediate line 15.

The faces F1-F4 are also delimited by unconnected lateral edges. In other words, the faces F1-F4 are delimited by ridges (the lateral edges) which are curves parameterized in a three-dimensional orthonormal Cartesian coordinate system, one of said dimensions being combined with the direction of said axis X, the coordinates of said parameterized curves changing in the three directions of said Cartesian coordinate system and said parameterized curves not being combined with one another at any point between said distal end 16 and said proximal end 14.

Said ridges thus have a complex outline although one obtained with faces that remain easy to produce. This outline is particularly advantageous for catching hold of the eyelashes and lengthening them.

In order to facilitate the return of the brush 10 into its container, the envelope of the applicator 10 can have chamfers 20 on some of its faces, at the distal end 16 of the core 12. In fact the distal end 16 is usually the end by which contact is made with the container when the user stores the applicator 10 after use. Preferably, the envelope comprises at least two opposed faces F1, F3, with chamfers 20 that are symmetrical relative to a median plane passing through said core 12. The height of these chamfers 20 will be in the range between 0 (no chamfers) and 5 mm.

It should be noted that the width of the envelope E is functionally related to the advantages of the applicator 10; said width varies along the axis X, between extremes, said extremes being referenced dmax, dmin in FIGS. 1 to 4. What is more, dmax, dmin correspond to the diameters of the envelope in the vicinity of the apexes of the raised parts for dmax and of the hollows for dmin.

Thus, the following formula will advantageously be followed:

$$0.125 \leq dmin/dmax \leq 0.625.$$

For example, dmax will be in the range between 6 and 8 mm and dmin will be in the range between 3 and 4.5 mm.

The invention also relates to a method for manufacturing an applicator for a cosmetic product, in particular mascara, for example the applicator that has just been described.

This method comprises firstly a step of positioning a plurality of fibres between longitudinal parts of a spindle (not shown). The fibres are distributed in such a way that said longitudinal parts run substantially at the middle of each of said fibres.

The next step of said method is a first step of twisting said spindle in order to form a twisted spindle that has fibres extending radially around it. The ends of said fibres then form a cylindrical envelope extending in a longitudinal direction of extension around said spindle. The fibres are distributed in the form of spirals of fibres because of the twisting of the spindle.

The step that follows is a step of cutting the fibres, so that said fibres form an envelope E with their free end, said envelope E having curved faces F1-F4 with at least one slope, or inclination, from said distal end to said proximal end, said slope or inclination changing direction from one face F1, F3 to the other F2, F4 so that said envelope E has hollows alternating with raised parts around said core 12, in particular an envelope E such as that described above. Said cutting can be controlled digitally.

Advantageously, the portion of the spindle devoid of fibres that extends the proximal end 14 will be intended to be fixed to the inside of a hollow rod, itself connected to a handle whereby the user will manipulate said applicator. It can be twisted or otherwise.

It should be noted that the applicator of the invention advantageously forms a twisted brush.

It should further be noted that the embodiments shown in FIGS. 1 to 4 can advantageously be combined in order to combine the make-up effects thereof, or even with a view to obtaining new effects.

It will be appreciated that variant embodiments are possible. In particular, it is also conceivable in an embodiment not shown here to provide the envelope E in a helical form. In other words, the edges of the faces described above could follow a helix from the proximal end 14 to the distal end 16 of the applicator 10, for example by virtue of a second twisting step of the method according to the invention.

We claim:

1. Applicator for a cosmetic product, in particular mascara, comprising a twisted core and fibres that extend from the core being held by said core, said core having a distal end and a proximal end, said fibres forming an envelope (E) with their free end, characterised in that said envelope (E) has curved faces (F1-F4) with at least one slope, or inclination, from said distal end to said proximal end, said slope or inclination changing direction from one face (F1, F3) to the other (F2, F4) so that said envelope (E) has hollows alternating with raised parts around said core.

2. Applicator according to claim 1, wherein said faces (F1-F4) are delimited by unconnected lateral edges.

3. Applicator according to claim 2, wherein the direction of said slope, or inclination, is inverted alternately around said core, from one face (F1, F3) to the other (F2, F4).

4. Applicator according to claim 2, wherein the core has a region situated between its distal end and its proximal end, known as the intermediate region, which in particular is substantially equidistant from said distal and proximal ends, the envelope (E) comprising a pair of curved faces (F1, F3) that have a concave undulation from the distal end to said intermediate region and a convex undulation from said intermediate region to the proximal end, and a pair of curved faces (F2, F4) that have a convex undulation from the distal end to said intermediate region and a concave undulation from said intermediate region to the proximal end.

5. Applicator according to claim 1, wherein the direction of said slope, or inclination, is inverted alternately around said core, from one face (F1, F3) to the other (F2, F4).

6. Applicator according to claim 5, wherein the core has a region situated between its distal end and its proximal end, known as the intermediate region, which in particular is substantially equidistant from said distal and proximal ends, the envelope (E) comprising a pair of curved faces (F1, F3) that have a concave undulation from the distal end to said intermediate region and a convex undulation from said intermediate region to the proximal end, and a pair of curved faces (F2, F4) that have a convex undulation from the distal end to said intermediate region and a concave undulation from said intermediate region to the proximal end.

7. Applicator according to claim 1, wherein the envelope (E) comprises a pair of curved faces (F2, F4) which are substantially convex from the distal end to the proximal end of the core, and a pair of curved faces (F1, F3) which are substantially concave from the distal end to the proximal end of the core.

8. Applicator according to claim 1, wherein the core has a region situated between its distal end and its proximal end, known as the intermediate region, which in particular is substantially equidistant from said distal and proximal ends, the envelope (E) comprising a pair of curved faces (F1, F3) that have a concave undulation from the distal end to said intermediate region and a convex undulation from said intermediate region to the proximal end, and a pair of curved faces (F2, F4) that have a convex undulation from the distal end to said intermediate region and a concave undulation from said intermediate region to the proximal end.

9. Applicator according to claim 1, wherein each of the curved faces (F1-F4) is generated by a straight line, known as the generatrix line, said generatrix line being orthogonal to the core and orthogonal to the plane of symmetry of said face (F1-F4).

10. Applicator according to claim 1, wherein the envelope (E) has a transverse cross-section in a plane substantially orthogonal to the core, the shape of which is a polygon, along the entire length of said core, from said distal end to said proximal end.

11. Applicator according to claim 10, wherein said shape is a quadrilateral.

12. Applicator according to claim 1, wherein said envelope (E) has chamfers on all or part of its faces (F1-F4), at the distal end of said core.

13. Applicator according to claim 12, wherein said envelope (E) comprises at least two opposed faces (F1, F3) with chamfers symmetrical in relation to said core.

14. Applicator according to claim 1, wherein said envelope (E) is a helical envelope.

15. Method for manufacturing an applicator for a cosmetic product, in particular mascara, said method comprising:

a step of positioning a plurality of fibres between longitudinal portions of a spindle, then a first step of twisting said spindle in order to form a twisted spindle with fibres extending radially around it, the ends of said fibres forming a cylindrical envelope extending in a longitudinal direction of extension around said spindle, then a step of cutting the fibres, so that said fibres form an envelope (E) with their free end, said envelope (E) having curved faces (F1-F4) with at least one slope, or inclination, from said distal end to said proximal end, said slope or inclination changing direction from one face (F1, F3) to the other (F2, F4) so that said envelope (E) has hollows alternating with raised parts around said core.

16. Applicator for a cosmetic product, in particular mascara, obtained by the method according to the claim 15.

17. Container for a cosmetic product, in particular mascara, capable of containing an applicator according to claim 1.

* * * * *